US005295579A

United States Patent [19]

Focke et al.

[11] Patent Number: 5,295,579

[45] Date of Patent: Mar. 22, 1994

[54] PAPER TISSUE PACK, ESPECIALLY PAPER HANDKERCHIEF PACK

[75] Inventors: Heinz Focke; Harald Gosebruch, both of Verden, Fed. Rep. of Germany

[73] Assignee: Focke & Co (GmbH & Co), Verden, Fed. Rep. of Germany

[21] Appl. No.: 978,724

[22] Filed: Nov. 19, 1992

[30] Foreign Application Priority Data

Nov. 26, 1991 [DE] Fed. Rep. of Germany ..... 4138775

[51] Int. Cl.[5] ..... B65D 85/62

[52] U.S. Cl. ..... 206/494; 206/449

[58] Field of Search ..... 206/37, 449, 494, 812; 221/48, 51, 52

[56] References Cited

U.S. PATENT DOCUMENTS

| | | | |
|---|---|---|---|
| 3,207,361 | 9/1965 | Marcalus . | |
| 3,490,645 | 1/1970 | Glass et al. | 221/48 |
| 3,684,086 | 8/1972 | Harrison . | |
| 4,143,762 | 3/1979 | Spiegelberg . | |
| 4,175,673 | 11/1979 | McDonald et al. . | |
| 4,623,074 | 11/1986 | Dearwester . | |
| 4,785,970 | 11/1988 | Engelmayer . | |
| 4,913,311 | 4/1990 | Garcia . | |

FOREIGN PATENT DOCUMENTS

| | | |
|---|---|---|
| 225865 | 6/1987 | European Pat. Off. . |
| 1178355 | 9/1964 | Fed. Rep. of Germany . |
| 1245557 | 7/1967 | Fed. Rep. of Germany . |
| 8814394 | 4/1990 | Fed. Rep. of Germany . |
| 9106555 | 5/1991 | Fed. Rep. of Germany . |

*Primary Examiner*—Jimmy G. Foster

*Attorney, Agent, or Firm*—Sughrue, Mion, Zinn, Macpeak & Seas

[57] ABSTRACT

A paper tissue pack, especially a paper handkerchief pack is disclosed. When paper handkerchiefs are packed in soft packs, the individual paper handkerchiefs are supposed to be folded such that they can be readily withdrawn without any difficulties via a withdrawal opening of the pack and, at the same time, are ready for use as a result of a quick unfolding. To facilitate the withdrawal of the handkerchiefs, the paper handkerchief which is folded lengthways or breadthways is folded in a zigzag-shaped manner about transverse folding lines (26, 27, 28) transverse to the direction of withdrawal. As a result, the handkerchief is pulled out of the pack in a fanfold-like fashion. To facilitate the withdrawal even further, a grip tab (34) is attached to the paper handkerchief at a free edge (20) which faces a withdrawal opening. With this tab, the handkerchief can be readily grasped, withdrawn and unfolded.

11 Claims, 6 Drawing Sheets

PAPER TISSUE PACK, ESPECIALLY PAPER HANDKERCHIEF PACK

BACKGROUND OF THE INVENTION

The invention relates to a paper tissue pack, especially a paper handkerchief pack, having a wrapper of foil, paper or the like which surrounds a stack of folded paper tissues, in which pack the wrapper comprises a withdrawal opening for the paper tissues in the region of a large-surfaced front side and in which a marginal portion of a folding layer of a paper tissue which faces the withdrawal opening is exposed in the region of the withdrawal opening.

A wide selection of embodiments of soft packs for paper handkerchiefs, including embodiments having a reclosable opening, are already known in the art.

SUMMARY OF THE INVENTION

The present invention is directed to measures which facilitate the withdrawal of paper tissues from the pack. It is already known to arrange or fold the paper handkerchiefs in such a way that a folding layer of the tissue can be grasped between thumb and forefinger in the region of the opening of the pack and that the tissue can then be pulled out of the pack (DE-U-91 06 555.0). In this prior art paper handkerchief pack, the paper tissues can only be withdrawn via an opening which is located in a region which is directed towards an end face of the pack and which extends into the end face. Moreover, the tissues held in this known pack are supposed to be folded in such a way that they permit a "quick unfolding" of the withdrawn handkerchiefs.

The invention is based on the object to design the paper tissue pack by way of a specific arrangement of the tissues in such a way that it is possible, on the one hand, to quickly unfold the withdrawn tissues and, on the other hand, to readily withdraw the tissues while the opening can have practically any sort of design and arrangement.

To attain these object, the paper tissue pack mentioned in the introduction is characterized in that the paper tissues are folded in a zigzag-shaped or Z-shaped manner with Z-folding lines extending transverse to the direction of withdrawal.

Moreover, the zigzag-fold or Z-fold is designed according to the invention in such a way that at least three folding legs are formed in this configuration and that the folding leg which faces the withdrawal opening is substantially shorter than the following middle folding leg.

The invention is based on the finding that an easy and troublefree withdrawal of the individual paper handkerchiefs via the withdrawal opening can be carried out in a particular troublefree manner if the pulling movement applied by hand to the folded tissue effects a successive pulling out of the legs from a zigzag-fold. As a result, the tissue is unfolded over its entire length during withdrawal. All that needs to be done now is to open the folding tabs formed from longitudinal folds.

As a result of the folding in accordance with the invention, the pack can be provided with withdrawal openings of different shapes and arrangements in the region of a front side. Nevertheless, the Z-folding lines are always directed transverse to the withdrawal opening or to the direction of pull during withdrawal.

Additionally, the folding of the paper tissues is designed according to the invention in such a way, that a marginal portion of a single folding layer is exposed in the region of the withdrawal opening, ready for grasping.

Further features of the invention relate to the design and folding of the paper tissues and to the overall design of the paper tissue pack.

Exemplary embodiments of tile invention will be described below in detail with reference to the drawings, in which:

DESCRIPTION OF PREFERRED EMBODIMENTS

Figure 1:
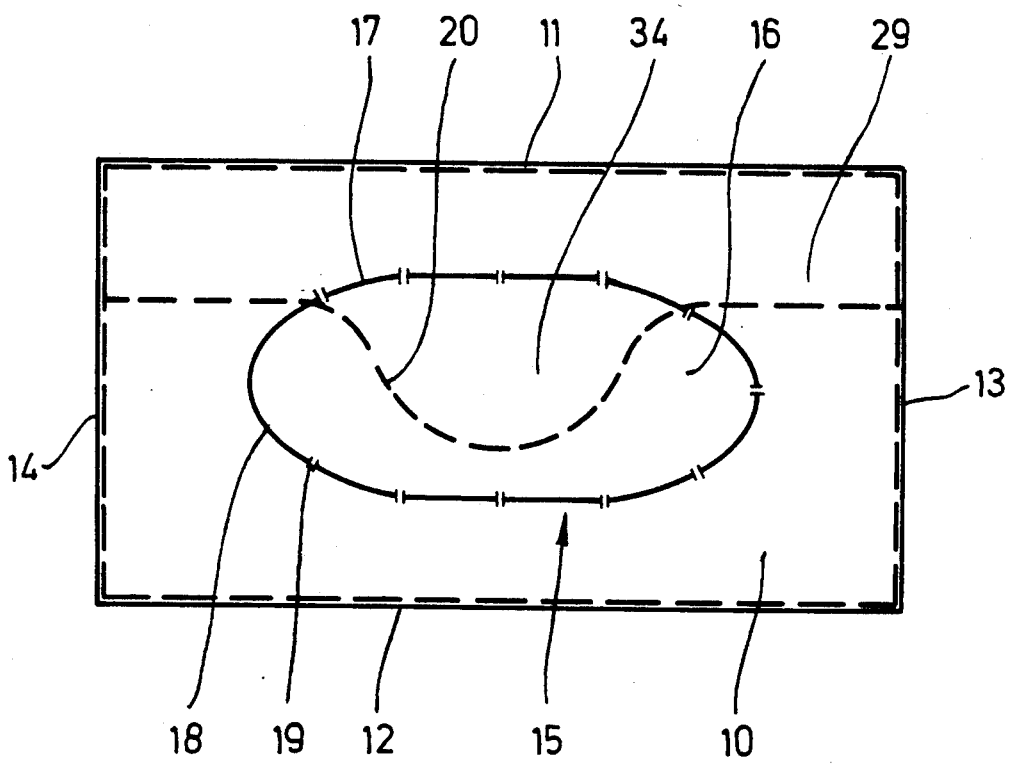
FIG. 1 shows a view of a front side of an embodiment of a paper handkerchief pack.

The exemplary embodiments illustrated in the drawings relate to paper handkerchief packs and to the arrangement of the paper handkerchiefs. Nevertheless, the invention can be readily used for other (paper) tissues.

The paper handkerchiefs are folded prior to packaging. A plurality of folded and stacked paper handkerchiefs form the contents of a paper handkerchief pack. This pack is formed from an outer wrapper of (plastic) foil, paper or, in exceptional cases, thin cardboard.

In the illustrated exemplary embodiments, the paper handkerchief packs have a cuboid shape. This shape is defined by a large-surfaced front side or front wall 10 and a correspondingly formed rear wall. Additionally, the package is bounded by elongated narrow side walls 11 and 12. A smaller end wall 13 of equal width extends transverse to the side walls and a bottom wall 14 extends opposite the end wall. The wrapper is formed from a blank which usually comprises folding tabs which overlap one another and are adhesively bonded or welded to one another in the region of the end wall 13 and bottom wall 14 and in the region of one of the two side walls 11, 12.

An opening 15 for the withdrawal of the handkerchiefs is located in the region of the front wall 10. In the exemplary embodiment of FIG. 1, the withdrawal opening 15 is disposed centrally within the front wall 10 and has an almost oval or at least elongated shape. The withdrawal opening 15 is oriented with its long axis in the direction of the longitudinal extension of the front wall 10.

Before the pack is put into use, the withdrawal opening 15 is closed by a portion of the front wall 10 which corresponds in shape to the withdrawal opening 15. A tear flap 16 is defined by a circumferential closed weakening line which takes the form of a perforation line 17 in the presently described embodiment. This line consists of longer punch cuts 18 and very short residual connections 19. When the tear flap 16 is grasped at a suitable place it can be severed from the withdrawal opening 15 in its entirety. As a result, a portion of the respective uppermost or foremost handkerchief is exposed.

The handkerchiefs of the pack are folded and arranged in the pack or wrapper in a special way. The paper handkerchiefs are folded such that a free single-layer edge 20 of each paper handkerchief is located in the region of the withdrawal opening 15. This free edge 20, which extends centrally or at a sufficient distance from the boundary of the withdrawal opening 15, is grasped for withdrawal between forefinger and thumb.

Figure 2:
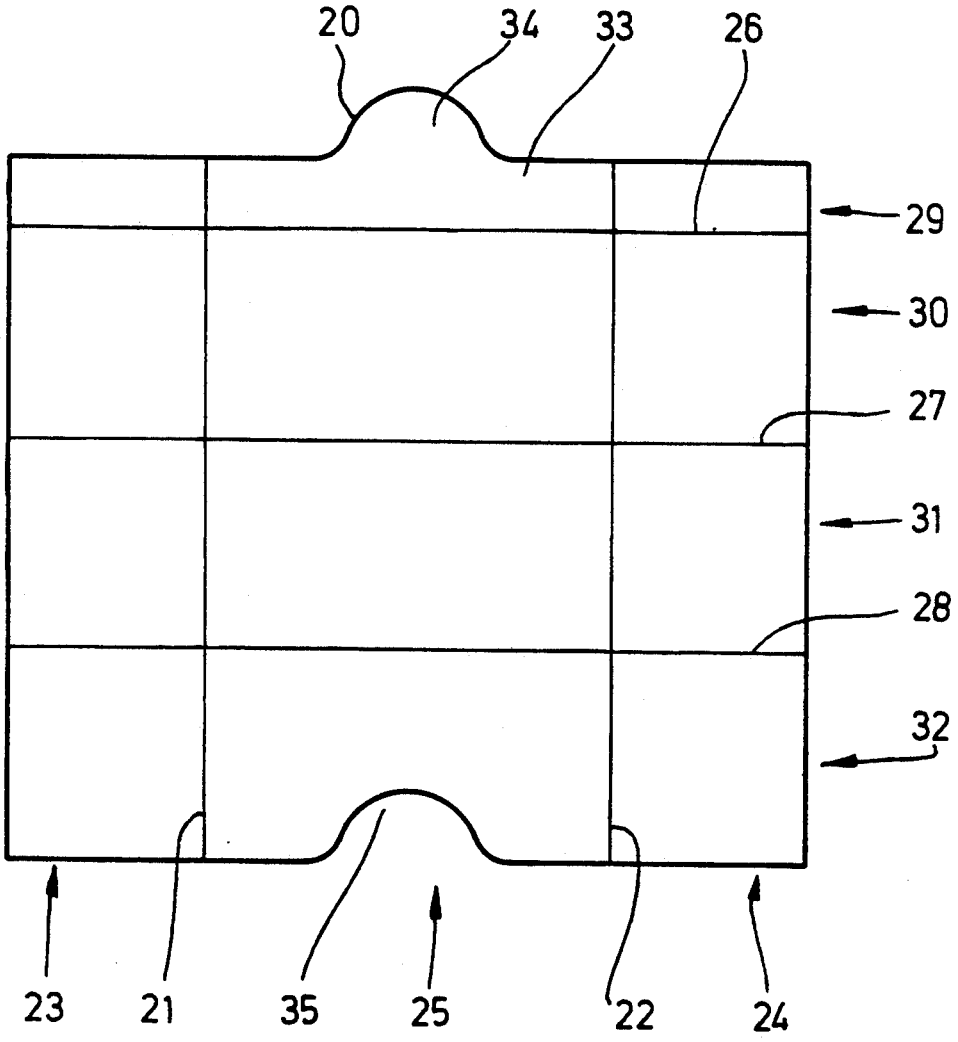
FIG. 2 shows an unfolded paper tissue (handkerchief)
Figure 3:
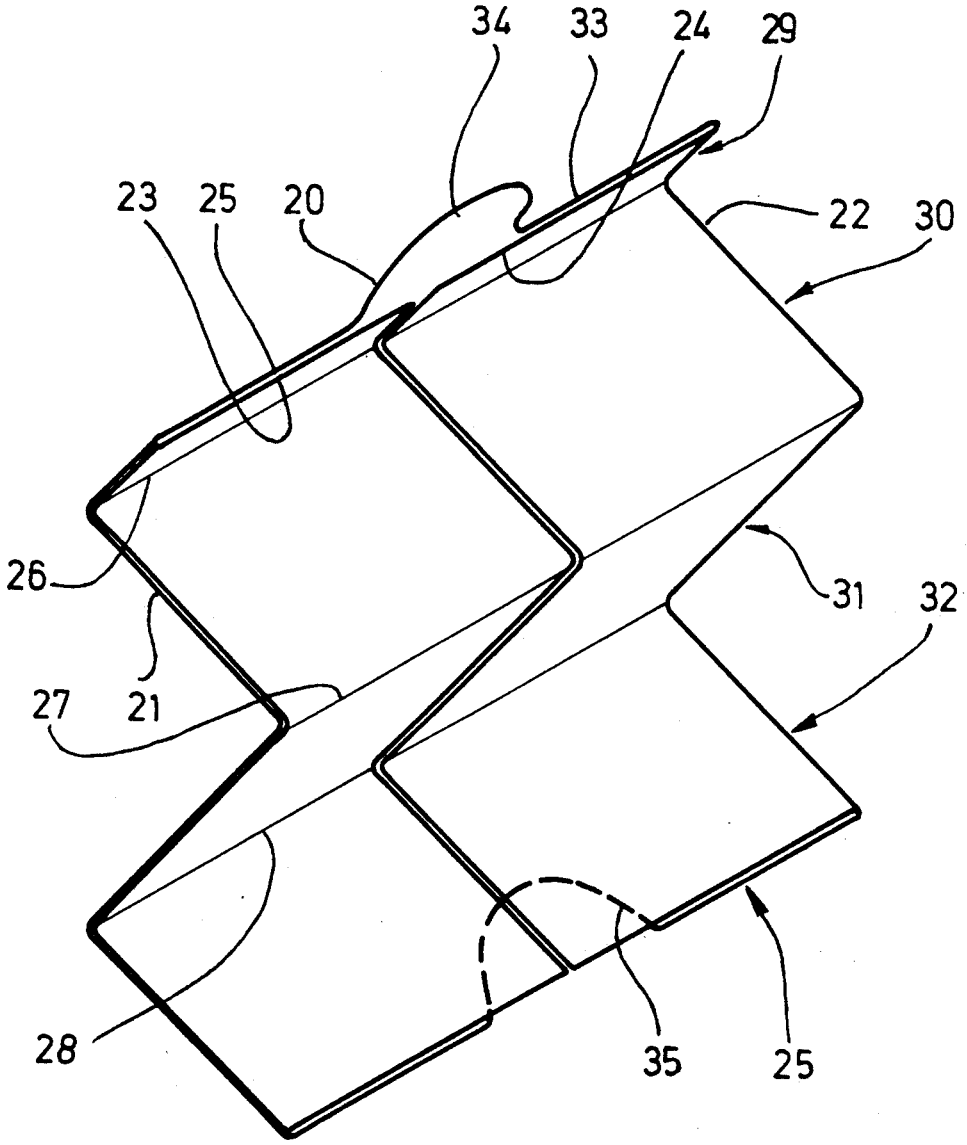
FIG. 3 shows a perspective view of the paper tissue of FIG. 2 in folded configuration.

In the exemplary embodiment of FIG. 1 to FIG. 3, the rectangular paper handkerchief is folded in the longitudinal and in the transverse direction. Longitudinal direction refers to the extension of the paper tissue in the direction of extraction. Because of the (greater) width of the handkerchief, two longitudinal folds are provided which are illustrated by longitudinal folding lines 21, 22. These longitudinal folding lines define longitudinal tabs 23, 24 which are folded inwards until they rest on a center part 25. The dimensions are defined such that each longitudinal tab 23, 24 covers approximately one half of the center part 25 (FIG. 3). In this intermediate folding position, the handkerchief is reduced to half of its width. This reduced width corresponds to the length of the pack, in particular to the dimension of the front wall 10 and rear wall of the pack in their longitudinal direction.

The handkerchief which is folded in the aforedescribed manner is now folded in a zigzag-shaped manner in a direction transverse to the longitudinal folding lines 21, 22 about several, and in the present case three transverse folding lines 26, 27, 28. As a result, several folding legs are formed. The embodiment of FIG. 3 has four folding legs 29, 30, 31, 32. As a result of the zigzag-shaped folding, these folding legs are directed in opposed directions. In the folded configuration, the ready-folded handkerchief thus assumes a concertina-like or fanfold-like shape.

In the embodiment of FIG. 1 to FIG. 3, three of the folding legs 30, 31, 32 have the same length, that is to say the same dimension in the longitudinal direction of the handkerchief. The dimensions are defined such that a folding leg 30, 31, 32 corresponds to the inner face of the pack of FIG. 1 and thereby to the size of the front wall 10 and rear wall. The dimensions of the marginal fourth leg 29 are substantially smaller in the longitudinal direction of the handkerchief, such that the free outer edge 20 of the folding leg 29 extends (partially) within the withdrawal opening 15. Accordingly, the handkerchief can be grasped preferably centrally at this edge 20 of an outer folding layer 33 of the folding leg 29 and can be pulled out of the pack.

In this process, the special feature of the zigzag-fold takes effect. The folding legs 29, 30, 31 and 32 are pulled out of the withdrawal opening 15 one after the other without jamming or getting caught. Additionally, the grasping of a single folding layer 33 permits a quick unfolding of the handkerchief by means of shaking it out.

The handkerchiefs are folded such that the folded longitudinal tabs 23, 24 are located on the inside in the region of the outer or upper folding leg 29. Consequently, the center part 25 is located on the outside in the region of this outer folding leg 29 which is to be grasped.

In the exemplary embodiment of FIG. 1 to FIG. 3, the withdrawal process is facilitated by a grip tab 34. This grip tab is formed at the edge 20 of the outer free folding layer 33, in particular centrally. The grip tab 34 is located entirely within the withdrawal opening 15, in particular at a distance from the boundary of the opening. As a result, the grip tab 34 is particularly easy to grasp. The withdrawal process then continues in the aforedescribed manner. The grip tab 34 also facilitates the quick unfolding of the handkerchief.

The grip tab 34 does not require an additional expenditure of material. When the handkerchiefs are severed from a continuous web of the tissue material, a recess 35 is formed on the side which is located opposite the grip tab 34. This recess has the same shape and size as the grip tab. The grip tab 34 for the following handkerchief is cut out from this recess. As a result, there is no waste at all. The recess 35 does not affect the utility of the handkerchief.

The folding concept for the handkerchiefs and the withdrawal of the handkerchiefs from the pack is also suitable for other embodiments of withdrawal openings and tear flaps.

Figure 4:
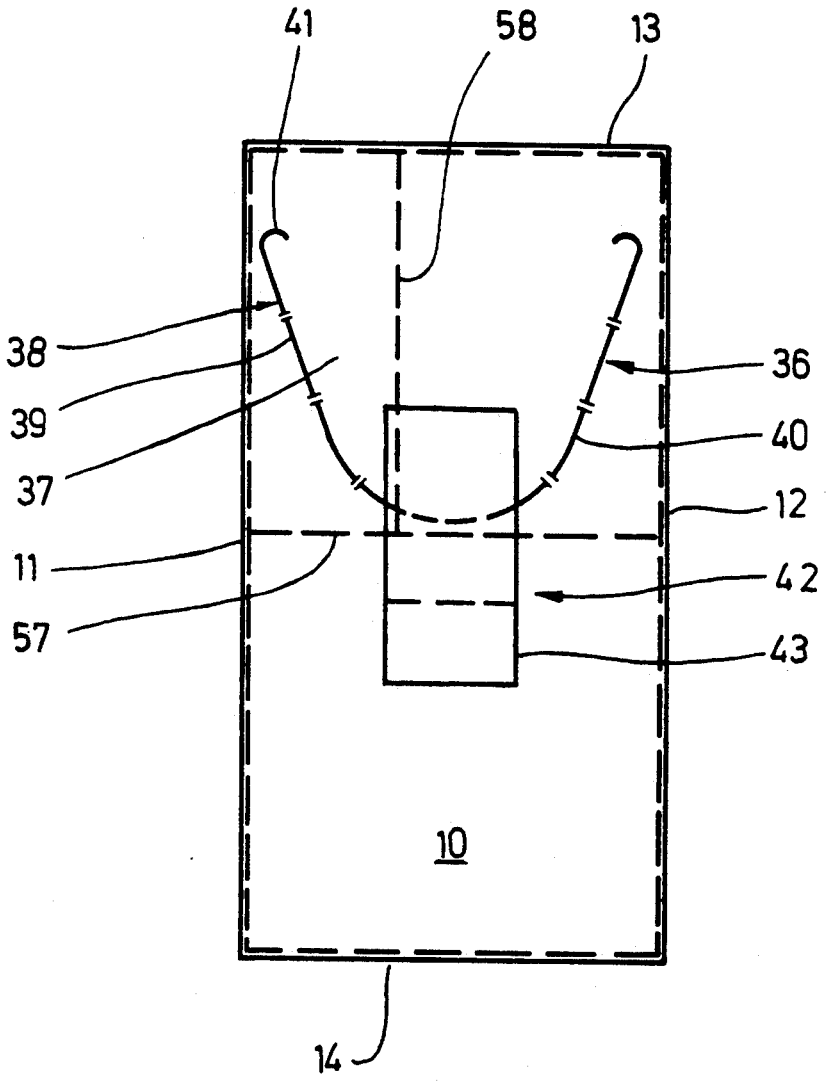
FIG. 4 shows a view of the front side of another embodiment of a paper tissue pack.
Figure 5:
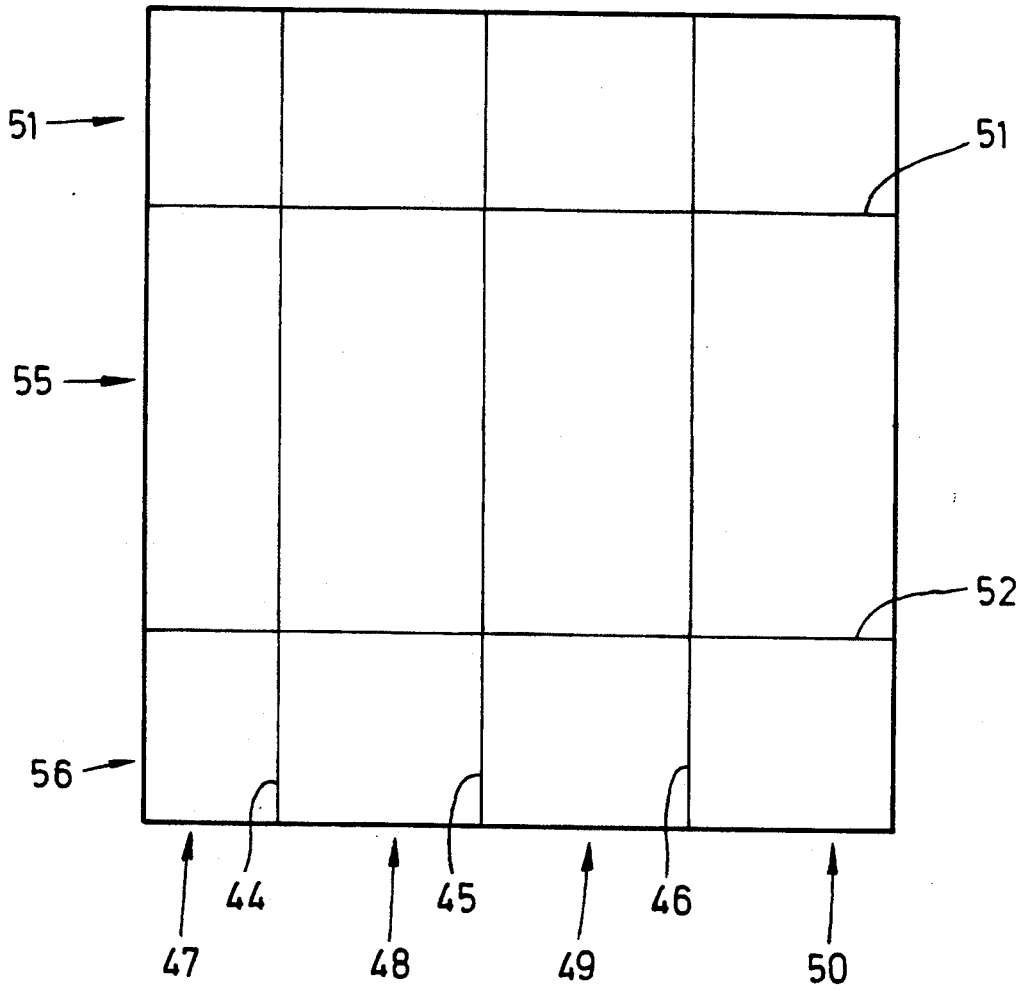
FIG. 5 shows an unfolded paper tissue (handkerchief)
Figure 6:
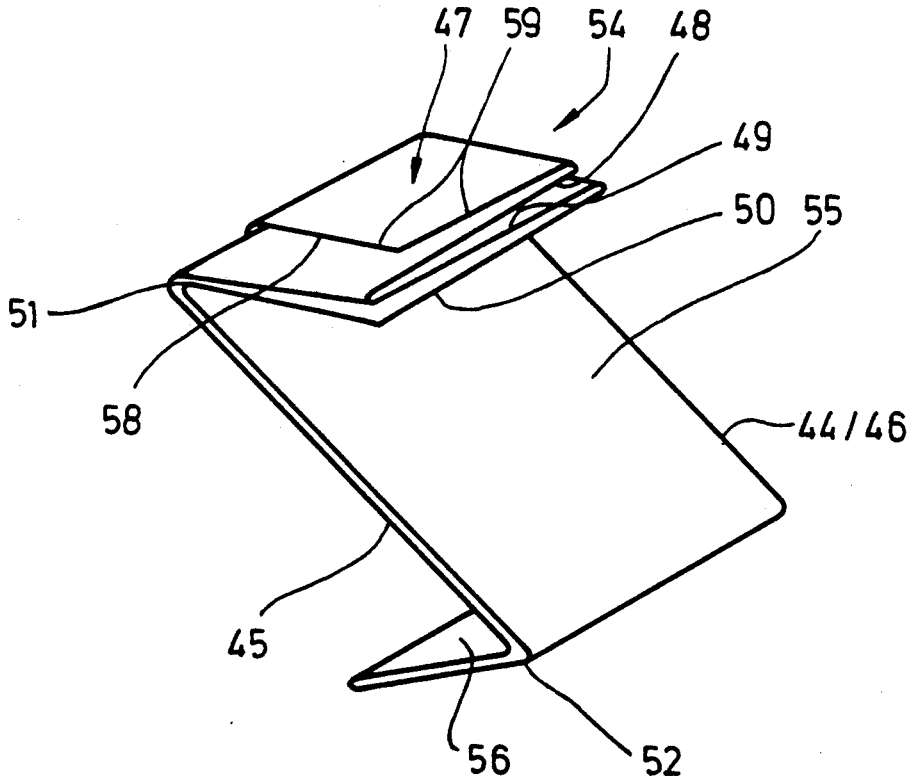
FIG. 6 shows a perspective view, similar to FIG. 3, of the paper handkerchief of FIG. 5 in folded configuration.

In the exemplary embodiment of FIG. 4 to FIG. 6, a withdrawal opening 36 is formed in the region of the front wall 10 and extends in spaced relationship adjacent to the end wall 13 in the transverse direction over nearly the entire width of the front wall 10. In this embodiment, the withdrawal opening 36 is associated with a tear flap 37 which permits a reclosure of the pack after the withdrawal of paper handkerchiefs. For this purpose, the tear flap 37 is defined by an almost V-shaped perforation line 38. As a result, the tear flap 37 has an altogether tongue-like design. Lateral legs 39, 40 of the perforation line 38 diverge in the direction towards the end wall 13. Ends of the perforation line 38 or the legs 39, 40 are provided with a curved deflection 41. This deflection prevents a tearing of the foil beyond the end of the legs 39, 40. When the pack is opened, the tear flap 37 forms a swivel axis at the level of the ends of the perforation line 38, i.e. at the level of the deflections 41.

The tear flap 37 is associated with an adhesive tape 42 in order to be actuated. One portion of this adhesive tape 42 is adhesively connected to the tear flap 37 and another portion to the front wall 10 outside the region of the tear flap 37. One end of the adhesive tape 42 which is located outside the tear flap 37 is adhesive-free and serves as a grip end 43 for grasping the adhesive tape 42. The tape is pulled off the front wall 10 by hand when the pack is opened. The tear flap 37 is taken along by the adhesive tape 42 and the perforation line 38 is severed. As a result, the tear flap 37 reaches an open position in which the withdrawal opening 36 which extends over nearly the entire width of the pack is exposed. Now, a paper handkerchief can be withdrawn via the withdrawal opening.

In the presently described exemplary embodiment, the paper handkerchief as illustrated in FIG. 5 is also rectangular in shape and is, first of all, folded in the region of three longitudinal folding lines 44, 45, 46, such that an elongated structure is formed which has a four-layer portion and a three-layer portion. The longitudinal folding lines 44, 45, 46 bound four folding strips 47, 48, 49 and 50. The folding strips 48, 49 and 50 are dimensioned such that they correspond to the width of the pack of FIG. 4. The marginal folding strip 47 has a substantially smaller width. In the completely folded handkerchief, this folding strip 47 is located on the top side, in particular in the region of the withdrawal opening 36. In the present case, the fold along the longitudinal folding lines 44, 45, 46 has a Z-like or zigzag-like shape (FIG. 6).

The paper handkerchief, which is thus folded to an elongated strip-shaped structure, is now folded about several, in particular two transverse folding lines 51 and 52 transverse to the longitudinal folding lines 44..46. This folding is necessarily a Z-shaped or zigzag-shaped folding, as is evident from FIG. 6. As a result, three folding legs 54, 55 and 56 are formed from the paper handkerchief which is folded in a multilayer fashion. The aforementioned folding legs 54..56 differ in length. The length of the middle folding leg 55 corresponds to the longitudinal dimension of the pack. The shorter folding legs 54 and 56 are in this case dimensioned in such a way that they do not overlap. Each of them corresponds approximately to half the dimension of the middle folding leg 55. As a result, the ready-folded handkerchief has a substantially uniform thickness.

The outer or upper folding leg 54 faces the withdrawal opening 36. The design and dimensions of the folding leg 54 and the arrangement, design and dimension of the withdrawal opening 36 are defined such that a portion of the folding leg 54 which is directed towards a free end portion or end edge 57 extends outside the region of the withdrawal opening 36 with a slight overlap. When the tear flap 37 is torn out and the pack 4 is opened, the end edge 57 is not exposed within the withdrawal opening 36. Instead, a free side edge 58 of an outer or upper individual folding layer 59 of the paper handkerchief extends in the region of the withdrawal opening 36, in particular transverse to the direction of withdrawal of the handkerchief. When the pack is open, i.e. when the tear flap 37 is swung back, the side edge 58 is exposed. In this region, the upper folding layer 59 of the shorter folding strip 47 can be grasped and the handkerchief can be pulled out of the pack.

In this withdrawal process, the Z-folding about the transverse folding lines 51, 52 again takes effect. The handkerchief is pulled out of the pack section by section. First, the folding leg 54 is pulled out, then the folding leg 55 and finally the folding leg 56. The withdrawn handkerchief is held in such a way that it can be opened by way of a quick unfolding. The exemplary embodiment of FIG. 4 to FIG. 6 may also comprise a grip tab 59 which is attached to the paper handkerchief in the region of the folding layer 59 to facilitate the grasping of the handkerchief.

We claim:

1. A paper tissue pack having a wrapper of foil or paper which surrounds a stack of folded paper tissues, wherein the wrapper comprises a withdrawal opening for the paper tissues in a large-surfaced front wall of the pack, thereby permitting withdrawal of the paper tissues in a direction from the pack, wherein each paper tissue has an outer folding layer with a free edge portion, wherein the free edge portion of the outer folding layer facing the withdrawal opening is exposed in a region of the withdrawal opening, wherein the paper tissues are folded in a zig-zag fold with Z-folding lines (26, 27, 28; 51, 52) extending transverse to the direction of withdrawal;

wherein, for grasping a paper tissue, each paper tissue is provided with a grip tab (34) in a region of the withdrawal opening (15) at the free edge of the outer folding layer which faces the withdrawal opening (15); and wherein a recess (35) is formed on a side of each paper tissue by punching out a grip tab of an adjacent paper tissue, said side being located opposite the grip tab (34).

2. A paper tissue pack having a wrapper of foil or paper which surrounds a stack of folded paper tissues, wherein the wrapper comprises a withdrawal opening for the paper tissues in a large-surfaced front wall of the pack, thereby permitting withdrawal of the paper tissues in a direction from the pack, wherein each paper tissue has an outer folding layer with a free edge portion, so that the free edge portion of the outer folding layer facing the withdrawal opening is exposed in a region of the withdrawal opening, wherein the paper tissues are folded in a zig-zag fold with Z-folding lines (26, 27, 28; 51, 52) extending transverse to the direction of withdrawal;

wherein, for grasping of a paper tissue, each paper tissue is provided with a grip tab (34) in a region of the withdrawal opening (15) at the free edge portion of the outer folding layer which faces the withdrawal opening (15);

wherein the withdrawal opening (15) is formed approximately centrally in the front wall (10) with a longitudinal extension in the direction of a longitudinal extension of the front wall (10), wherein the free edge portion (20) extends within the withdrawal opening (15), and wherein the grip tab (34) which is also located within the withdrawal opening (15) is attached to the free edge portion (20).

3. The paper tissue pack according to claim 1 or 2, wherein each paper tissue has at least three folding legs (29, 30, 31, 32; 54, 55, 56) in the zigzag-fold, which comprises a first folding leg and a following middle folding leg, wherein the first folding leg (29; 54) faces the withdrawal opening (15; 36) and is substantially shorter than the following middle folding leg (30; 55).

4. The paper tissue pack according to claim 1 or 2, wherein the outer folding layer (59) which faces the withdrawal opening (36) is shorter than folding layers located under the outer folding layer.

5. The paper tissue pack according to claim 1 or 2, wherein each paper tissue has at least three folding legs (29, 30, 31, 32; 54, 55, 56) in the zigzag-fold which comprises a first folding leg and a following middle folding leg, wherein the first folding leg (29; 54) faces the withdrawal opening (15; 36) and is substantially shorter than the following middle folding leg (30; 55);

wherein each paper tissue is folded in a longitudinal direction along two longitudinal folding lines (21, 22), such that two longitudinal tabs (23, 24) are located on the same side of a center part (25) of the tissue, and wherein each longitudinal tab (23, 24) corresponds to approximately half the surface area of the center part (25) and rests against the center part without overlapping the other longitudinal tab.

6. The paper tissue pack according to claim 5, wherein a middle folding leg (30, 31; 55) of each of the folded paper tissues corresponds to dimensions of the pack front wall (10).

7. A paper tissue pack wherein:

the pack is of cuboid shape and has a wrapper foil or paper which surrounds a stack of folded individual paper tissues;

in a region of a large-surfaced front wall (10), the pack has a central elongated withdrawal opening (15) for the paper tissues, said opening extending with a longitudinal dimension in the direction of a longitudinal extension of the front wall (10);

each of the paper tissues is first folded in the longitudinal direction along two longitudinal folding lines (21, 22), such that two longitudinal tabs (23, 24) are located on the same side of a center part (25) of the tissue, and such that each longitudinal tab (23, 24) covers approximately half the surface area of the center part (25) and rests against the center part without overlapping the other longitudinal tab;

the paper tissue which has been first folded also is second folded in a zigzag fold about transverse folding lines (26, 27, 28) to produce a plurality of folding legs (29, 30, 31, 32) which can be pulled out of the pack in succession when the paper tissues are withdrawn from the pack; and one of the folding legs (29) which faces the withdrawal opening (15) is substantially shorter than the following folding legs (30) and forms a free edge (20) for grasping the paper tissue, said free edge extending within the withdrawal opening (15) in the longitudinal direction of the front wall (10) over the entire longitudinal length of the front wall.

8. The paper tissue pack according to claim 7, wherein, for grasping of the paper tissues, each paper tissue is provided with a grip tab (34) in a region of the withdrawal opening (15) and at the free edge (20) of an outer folding layer (33) which faces the withdrawal opening (15).

9. The paper tissue pack according to claim 8, wherein a recess (35) is formed on a paper tissue side, located opposite the grip tab (34), by punching out a grip tab of an adjacent paper tissue.

10. A paper tissue pack wherein:

the pack is of cuboid shape and has a wrapper of foil or paper which surrounds a stack of folded individual paper tissues;

in a large-surfaced front wall (10), the pack has a withdrawal opening (36) which is formed in a region which is directed toward an end wall (13) of the pack, but at a distance from said end wall (13);

the withdrawal opening (36) is associated with a tear flap (37) for the reclosure of the pack after a withdrawal of paper tissues;

the paper tissues have longitudinal folding lines (44, 45, 46) and, transversely thereto, transverse folding lines (51, 52) of which at least the transverse folding lines (51, 52) are Z-type folding lines, such that the paper tissues are folded in a zigzag form in the transverse direction;

each paper tissue is first folded, at the longitudinal folding lines (21, 22) and, thereafter, second folded at the transverse folding lines in the zigzag form in such a way that folding legs (54, 55, 56) of the paper tissues can be pulled out of the pack in succession when the paper tissues are withdrawn; and an outer folding layer (59) which is directed toward the withdrawal opening (36) is shorter than other folding layers located under the outer folding layer and extends with a transversely directed end edge (57) outside the withdrawal opening (36) and the tear flap (37) at a small distance therefrom, such that only a side edge (58) of the folding layer (59) extends in the longitudinal direction of the front wall (10) and is exposed in a region of the withdrawal opening (36).

11. The paper tissue pack according to claim 10, wherein the tear flap (37) has an adhesive tape (42) with an adhesive-free grip end (43) and is bounded by almost V-shaped perforation lines (38) which end with diverging legs (39, 40) at a distance from the end wall (13) and which have a curved deflection (41) at ends thereof which are directed towards the end wall (13).

* * * * *